US011834859B2

(12) United States Patent
Reynolds

(10) Patent No.: US 11,834,859 B2
(45) Date of Patent: Dec. 5, 2023

(54) MODULAR AND PORTABLE SHELTER WITH INTEGRATED HUB

(71) Applicant: Shawn P. Reynolds, Gloucester, MA (US)

(72) Inventor: Shawn P. Reynolds, Gloucester, MA (US)

( * ) Notice: Subject to any disclaimer, the term of this patent is extended or adjusted under 35 U.S.C. 154(b) by 2 days.

(21) Appl. No.: 17/444,972

(22) Filed: Aug. 12, 2021

(65) Prior Publication Data

US 2023/0050862 A1 Feb. 16, 2023

(51) Int. Cl.

| | |
|---|---|
| ***E04H 15/40*** | (2006.01) |
| ***E04H 15/56*** | (2006.01) |
| ***E04H 15/18*** | (2006.01) |
| *E04H 15/54* | (2006.01) |

(52) U.S. Cl.

CPC ..... *E04H 15/40* (2013.01); *E04H 15/18* (2013.01); *E04H 15/56* (2013.01); *E04H 15/54* (2013.01)

(58) Field of Classification Search

CPC ..... E04H 15/40
USPC ..... 135/135, 136
See application file for complete search history.

(56) References Cited

U.S. PATENT DOCUMENTS

| | | | | |
|---|---|---|---|---|
| 3,114,377 | A * | 12/1963 | Clement | E04H 15/40 D21/834 |
| 3,448,748 | A * | 6/1969 | Walrave | E04H 15/28 135/120.3 |
| 3,625,235 | A * | 12/1971 | Gorgichuk | E04H 15/26 135/92 |
| 4,981,387 | A * | 1/1991 | Younjae | E04H 15/36 403/174 |
| 5,078,096 | A | 1/1992 | Bishop et al. | |
| 6,381,767 | B1 * | 5/2002 | Brashears | E04H 4/108 135/124 |
| 6,694,546 | B1 * | 2/2004 | Kasem | A47D 13/06 5/93.1 |
| 6,701,948 | B2 | 3/2004 | Jopp et al. | |
| 8,001,986 | B2 | 8/2011 | Shumate | |
| 8,950,417 | B2 | 2/2015 | Yang | |
| 9,523,213 | B2 * | 12/2016 | Pyaga | E04H 15/16 |
| 9,777,508 | B2 | 10/2017 | Kalvani | |
| 10,119,298 | B2 | 11/2018 | Choi | |

(Continued)

FOREIGN PATENT DOCUMENTS

| | | |
|---|---|---|
| CN | 201763043 U | 3/2011 |
| CN | 203569964 U | 4/2014 |

(Continued)

*Primary Examiner* — Noah Chandler Hawk

(74) *Attorney, Agent, or Firm* — Dunlap Bennett & Ludwig, PLLC

(57) ABSTRACT

A modular and portable shelter is disclosed. The shelter includes a base designed to sit on a surface, such as the ground. The shelter also includes support poles, with each support pole including a first end that releasably couples to the base and a second end. Additionally, the shelter includes a hub defining a openings along an outer perimeter thereof, with each opening being angled downwardly and slidably receiving a respective second end of a respective support pole. Further disclosed is a shelter system which includes portable shelters positioned adjacently and coupled via connecting rods. The connecting rods detachably connect between the hubs of the adjacent portable shelters to form a larger overall structure.

9 Claims, 9 Drawing Sheets

(56) References Cited

U.S. PATENT DOCUMENTS

| | | | | |
|---|---|---|---|---|
| 10,443,263 | B2 | 10/2019 | LaHood | |
| 10,676,956 | B1 | 6/2020 | Kalvani | |
| 10,837,195 | B2 | 11/2020 | Wiseman | |
| 2005/0178420 | A1 | 8/2005 | Reis | |
| 2006/0064818 | A1 | 3/2006 | Danaher | |
| 2007/0017564 | A1* | 1/2007 | Lah | E04H 15/42 135/120.3 |
| 2013/0125947 | A1 | 5/2013 | Lee | |
| 2015/0337557 | A1 | 11/2015 | Youn | |
| 2016/0281385 | A1 | 9/2016 | Choi | |
| 2018/0223559 | A1* | 8/2018 | Lim | E04H 15/42 |
| 2019/0203501 | A1 | 7/2019 | LaHood | |
| 2020/0123802 | A1 | 4/2020 | Lafoux et al. | |

FOREIGN PATENT DOCUMENTS

| | | | | |
|---|---|---|---|---|
| CN | 209099880 | U | 7/2019 | |
| CN | 209195145 | U | 8/2019 | |
| CN | 209212043 | U | 8/2019 | |
| DE | 10346948 | A1 * | 5/2005 | E04H 15/40 |
| EP | 0137259 | A2 | 4/1985 | |
| EP | 2685029 | A1 | 1/2014 | |
| KR | 100997147 | B1 | 11/2010 | |
| KR | 20180092472 | A | 8/2018 | |

* cited by examiner

MODULAR AND PORTABLE SHELTER WITH INTEGRATED HUB

BACKGROUND OF THE INVENTION

The present invention relates to modular structures and, more particularly, to a modular groundsheet and portable shelter with an integrated hub that provides for multiple diverse arrangements.

Conventional products, such as blankets, lack many basic functionalities. For example, at the beach, they do an insufficient job at preventing sand from getting on the top thereof, which results in the user getting covered in sand. Further, the do not provide any type of cover, whether it be for privacy purposes or for protection from the elements (such as wind or rain). Even furthermore, they cannot be connected to form larger overall structures to accommodate varying numbers of individuals. Other products provide overly complex structures that still often do not provide all these functionalities.

As can be seen, there is a need for a modular groundsheet and canopy with integrated hub, that functions as a portable shelter, that ameliorates these aforementioned problems.

SUMMARY OF THE INVENTION

In one aspect of the present invention, a portable shelter comprises: a base configured to sit on a surface; a plurality of support poles, with each support pole comprising a first end that releasably couples to the base and a second end; and a hub defining a plurality of openings along an outer perimeter thereof, with each of the plurality of openings: being angled downwardly and slidably receiving a respective second end of a respective support pole of the plurality of support poles.

In another aspect of the present invention, a portable shelter system comprises: a first portable shelter comprising: a first base configured to sit on a surface; a first plurality of support poles, with each support pole of the first plurality of support poles comprising a first end that releasably couples to the first base and a second end; and a first hub defining a first plurality of openings along an outer perimeter thereof, with each of the first plurality of openings: being angled downwardly; and slidably receiving a respective second end of a respective support pole of the first plurality of support poles; and a second portable shelter comprising: a second base configured to sit on the surface; a second plurality of support poles, with each support pole of the second plurality of support poles comprising a first end that releasably couples to the second base and a second end; and a second hub defining a second plurality of openings along an outer perimeter thereof, with each of the second plurality of openings: being angled downwardly and slidably receiving a respective second end of a respective support pole of the plurality of support poles; and a connecting rod removably coupled to the first hub and the second hub to connect the first portable shelter and the second portable shelter.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention such that one skilled in the art will be enabled to make and use the invention, since the scope of the invention is best defined by the appended claims.

Broadly, one embodiment of the present invention is a modular and portable shelter. The shelter includes a base designed to sit on a surface, such as the ground. The shelter also includes support poles, with each support pole including a first end that releasably couples to the base and a second end. Additionally, the shelter includes a hub defining openings along an outer perimeter thereof, with each opening being angled downwardly and slidably receiving a respective second end of a respective support pole. Advantageously, the hub may also include rod connecting holes to allow adjacently positioned shelters to be detachably coupled to one another to form a larger overall structure.

Figure 1:
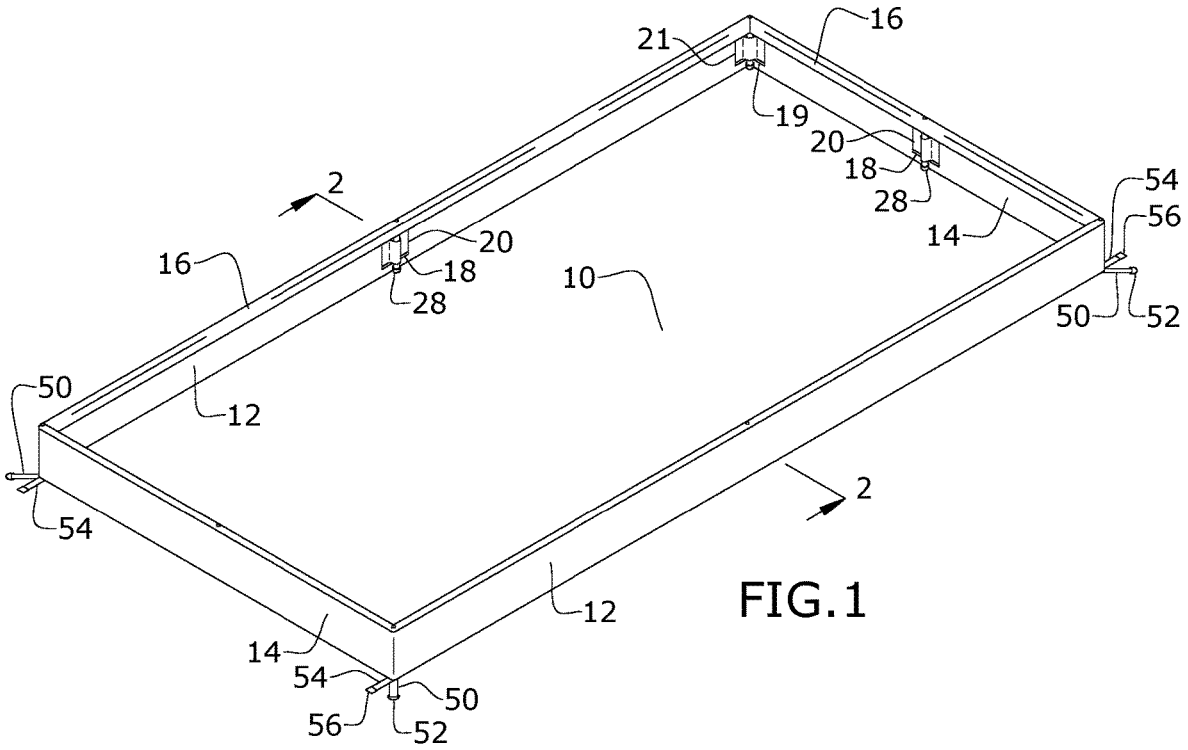
FIG. 1 is a perspective view of a base of an embodiment of the present invention.
Figure 2:
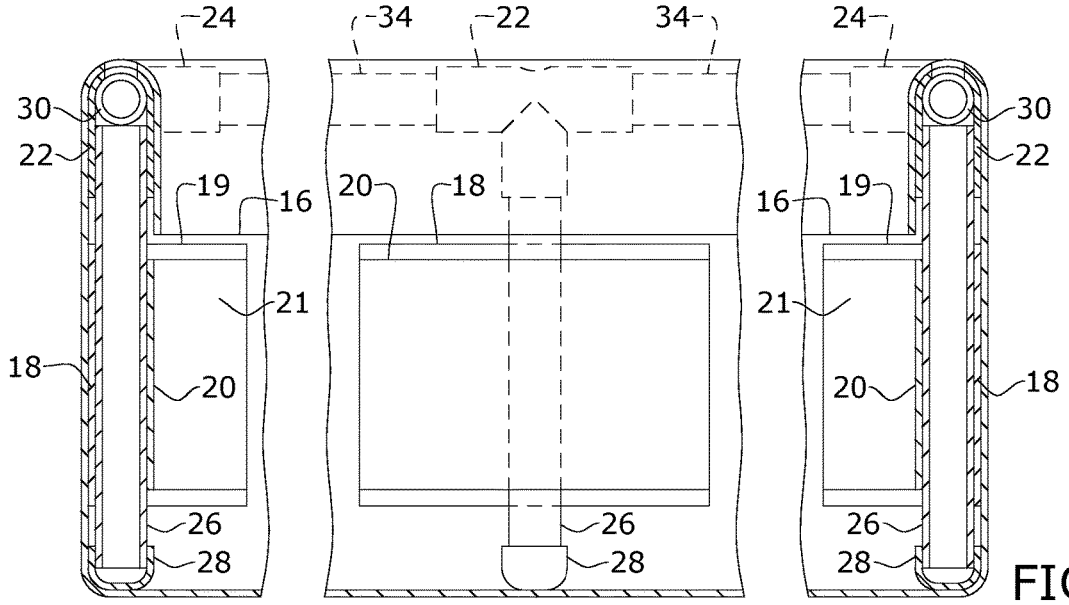
FIG. 2 is a section view taken along line 2-2 from FIG. 1.
Figure 3:
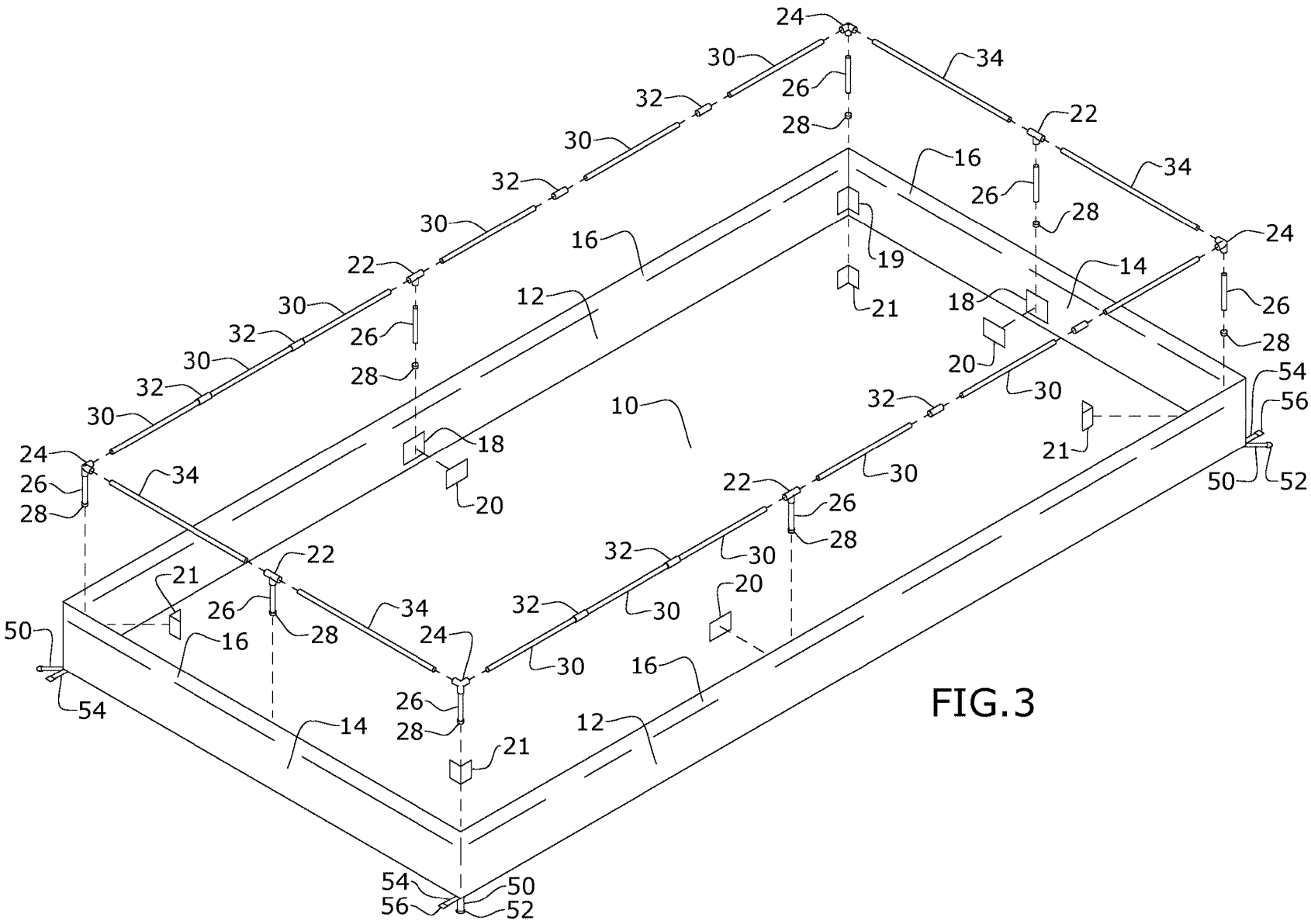
FIG. 3 is an exploded view of the base of the embodiment of the present invention.

Referring to FIGS. 1-3, a base of an embodiment of the present invention is generally shown. The base forms an improved groundsheet that better prevents various elements, such as dirt or sand, from getting on a base bottom 10 of the base. This is achieved, in part by sidewalls that include a base long wall 12 and a base short wall 14 that extend upwardly from the base bottom 10. This structure may include a singular waterproof sheet/membrane. In certain embodiments, these side walls may extend upwards approximately 6 inches. As best shown in FIGS. 2-3, a support structure maintains the overall shape of the groundsheet. While those with skill in the art will appreciate that various structures may be employed, the illustrated embodiment employs tubular supports coupled to one another, including: T-connectors 22; three-way elbow connectors 24; legs 26 with an end cap 28; long wall support tubes 30; couplings 32 for connecting the long wall support tubes 30; and short wall support tubes 34. For easy assembly of the connected tubular supports with the waterproof sheet, respective side leg loop patches 18 may be used in combination with side leg hook patches 20 to hold the side legs 26 in place, and corner leg loop patches 19 may be used in combination with corner leg hook patches 22 to retain corner legs 26 in place. In use, a portion of the waterproof sheet of the base is folded over a top of the tubular support structure to define a fold over lip 16. This lip 16 may be secured using clips or various other appropriate means to retain the waterproof sheet in place. Thus, the base of the present invention is an easy to assemble, use, and disassemble base that provides superior protection from particles or material that may otherwise be blown onto a blanket. In addition to the above, and as shown, for example, in FIG. 6, an exterior portion of the base may include ground anchor straps 50 at corners thereof, anchor rings 52, base straps 54, and male connectors 56 (which will be described in greater detail with respect to the canopy).

Figure 4:
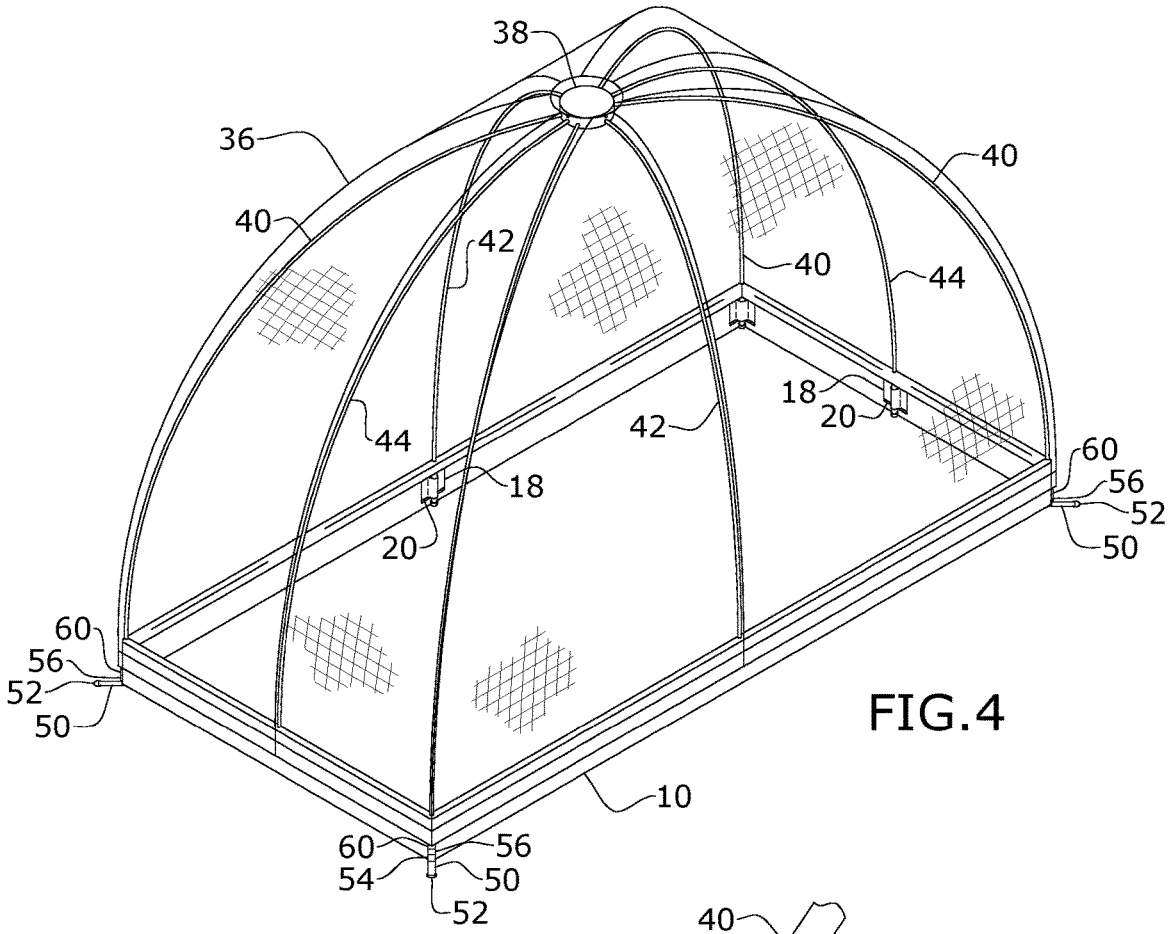
FIG. 4 is a perspective view of the embodiment of the present invention, shown with a canopy installed on the base in a first configuration.
Figure 6:
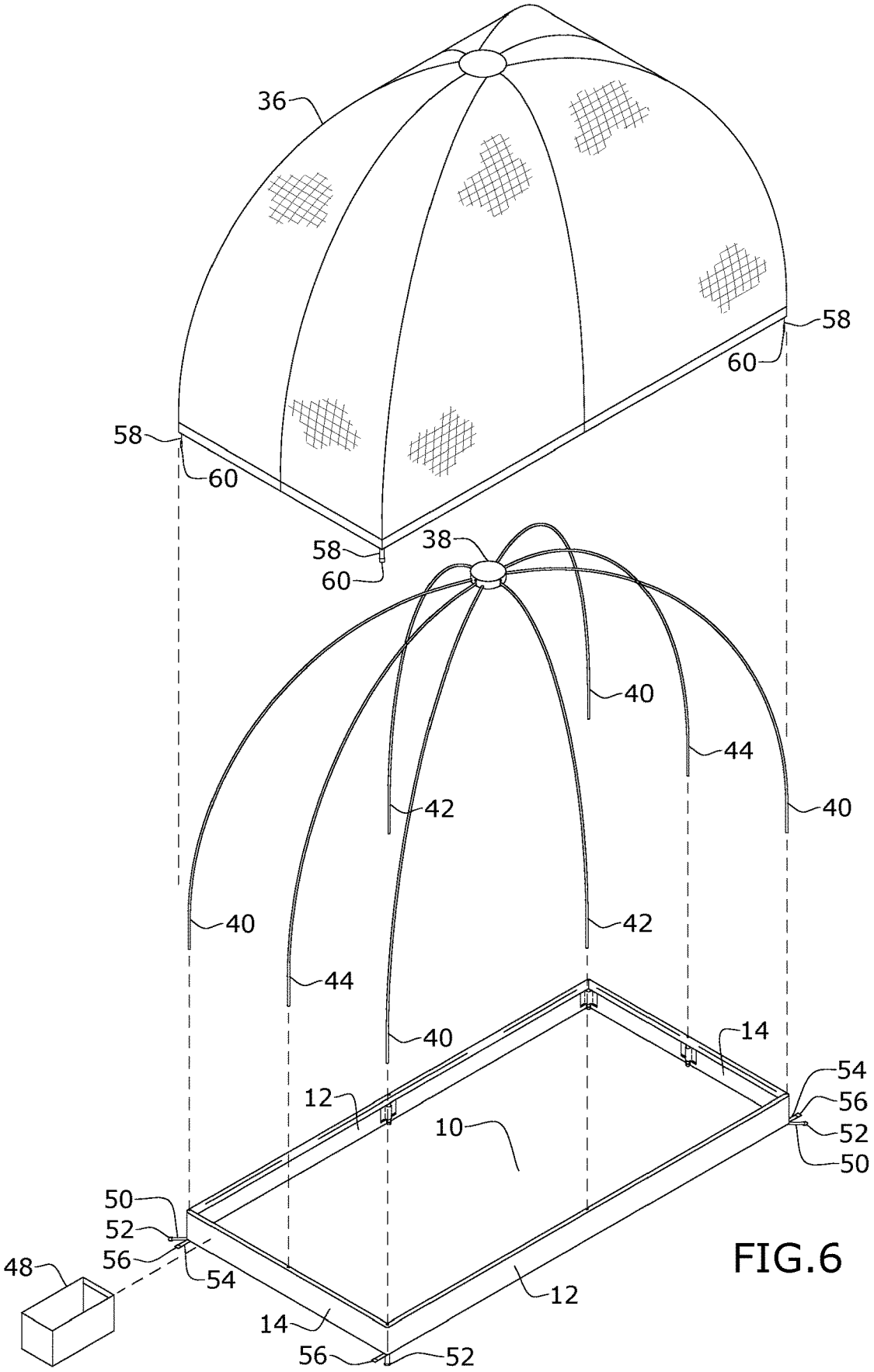
FIG. 6 is a partially exploded view of the embodiment of the present invention, shown with the canopy, support poles, and base separated from one another.

Referring now to FIGS. 4 and 6, a canopy 36 is provided that serves as a cover for the previously described base/groundsheet. The canopy 36 is supported by a modular pole and hub structure that is detailed further below. The canopy may be provided with canopy straps 58 and female connectors 60 for coupling to the base to maintain the canopy 36 in position. As will be appreciated by those with skill in the art, the canopy 36 may be provided with various materials, screens, zippers, etc. to provide a plurality points of ventilation and access to within the structure. Further provided is a foot wash basin 48 that is couplable to the base which may be filled with water to wash a user's feet prior to entry into the canopy structure.

Figure 5:
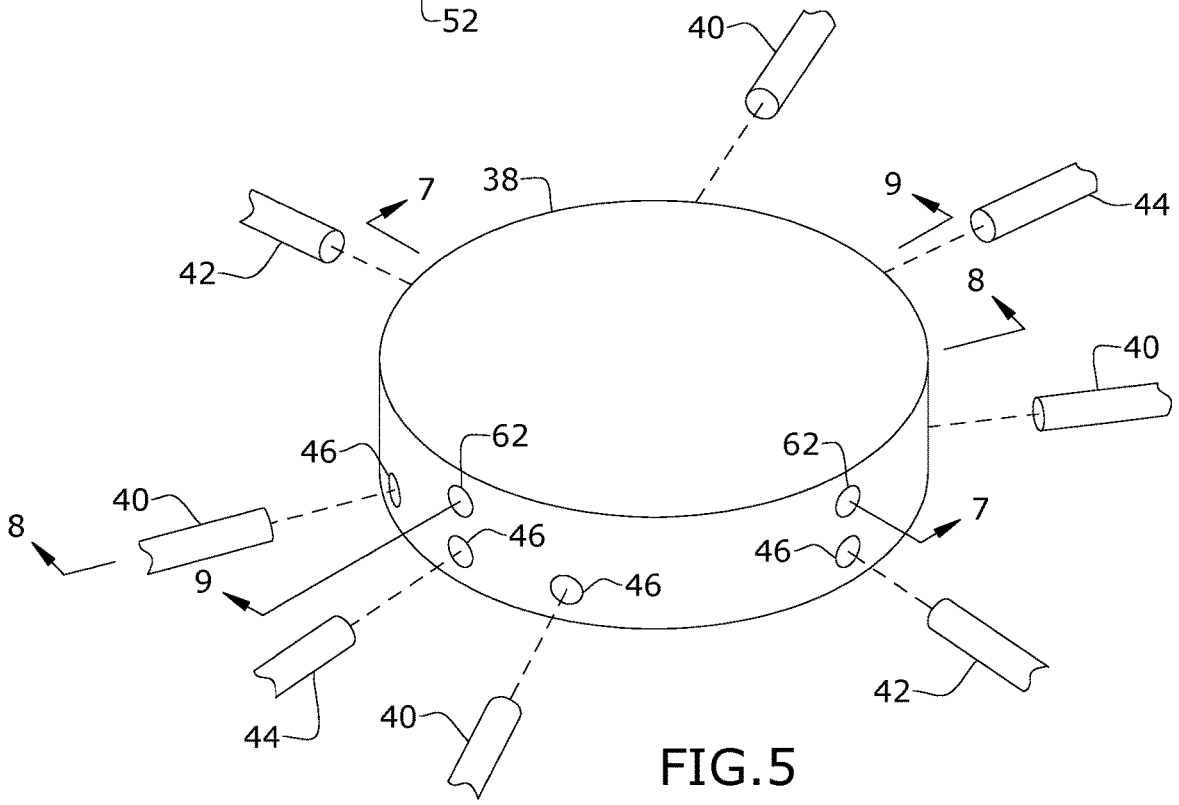
FIG. 5 is a perspective view of a hub of the embodiment of the present invention.

Advantageously, the canopy 36 is supported by a plurality of poles 40, 42, 44 that are substantially centrally (relative to the base) retained in place by a hub 38. The poles 40, 42, 44 may be formed from a flexible material. In certain embodiments, the hub 38 is substantially cylindrical in shape. The hub 38, in particular, is designed in such a way that a number of customized structures can be formed using one or more embodiments of the present invention and will be described in greater detail below. Corner poles 40 are provided that couple to corners of the base and are inserted into respective pole openings 46 in the hub 38, as shown in FIGS. 5 and 6. Likewise, side poles 42 and front/rear poles 44 also couple to the base at intermediate locations along the length and width thereof, and they also are inserted into pole openings 46 in the hub 38. The poles 40, 42, 44 may couple to the base using any appropriate connection type. These elements, in combination, form a portable shelter that is shown in FIG. 4. In certain embodiments, the hub 38 may be marked to denote how it should be oriented relative to the portable shelter.

Figure 7:
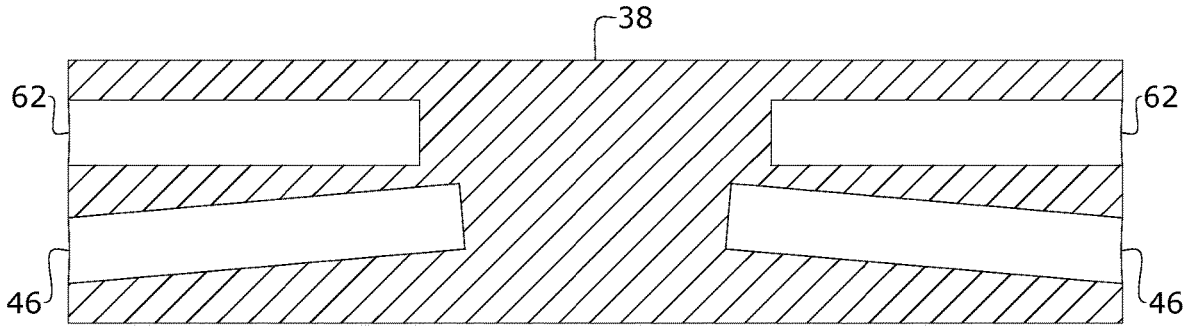
FIG. 7 is a section view taken along line 7-7 from FIG. 5.
Figure 8:
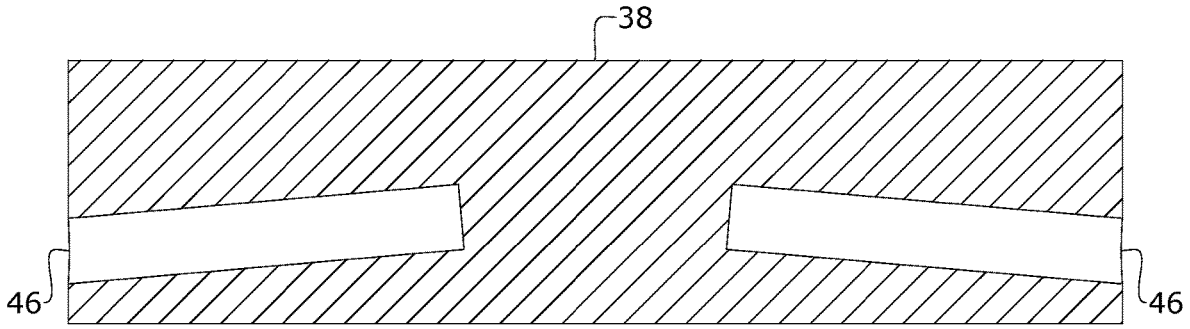
FIG. 8 is a section view taken along line 8-8 from FIG. 5.
Figure 9:
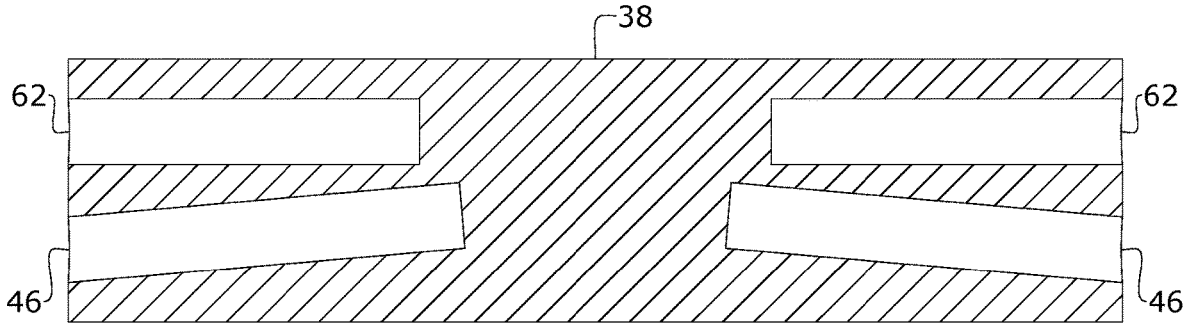
FIG. 9 is a section view taken along line 9-9 from FIG. 5.

The hub 38 is the structure by which a good portion of the customizability of the present invention is derived from. Tension between the hub 38 and the poles 40, 42, 44 maintain the structure created in position without the need for mechanical fasteners while allowing it to be easily collapsed and broken down into separate parts (e.g., the poles 40, 42, 44 can be removed from the hub when disassembled). As shown in FIGS. 7-9, the pole openings 46 are provided at a slight angle (e.g., approximately 4-5 degrees) relative to the bottom of the hub 38. Compared to a hole formed entirely horizontally relative to the bottom of the hub 38, these angularly formed pole openings 46 better maintain the poles 40, 42, 44 in place when in use.

Also critical to the customizability of the present invention are shelter connecting rod holes 62, which are formed above the pole openings 46. In certain embodiments, four of these rod holes 62 are provided, with them being oriented, in use, to respectively align with the four sides of the base. These rod holes 62 allow portable shelters to be arranged adjacently and removably coupled to one another and will be described in greater detail below. Further, as seen in FIGS. 7 and 9, the bottom pole openings 46 project into the hub 38 slightly further then the connecting rod holes 62, which the inventor has found to result in a more stable arrangement when connecting adjacent portable shelters (described in greater detail below).

It will be appreciated by those with skill in the art that the terms "hole" and "opening", in the context of pole openings 46 and rod holes 62, are used to better differentiate the two sets of hollow portions in the hub 38. However, this language is not intended to require that there necessarily be a fundamental structural difference between a hole and an opening, and the terms are interchangeable with one another. It will also be appreciated that the respective openings 46 and holes 62 may vary in diameter size.

Figure 10:
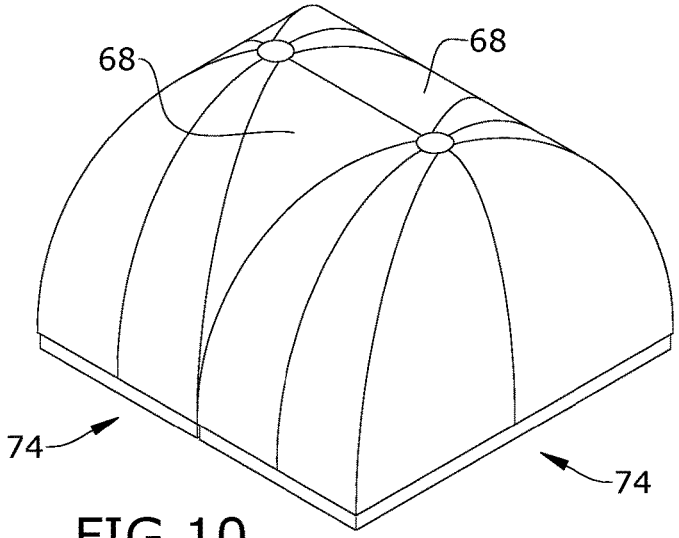
FIG. 10 is a perspective view of the embodiment of the present invention, shown in a second configuration.
Figure 11:
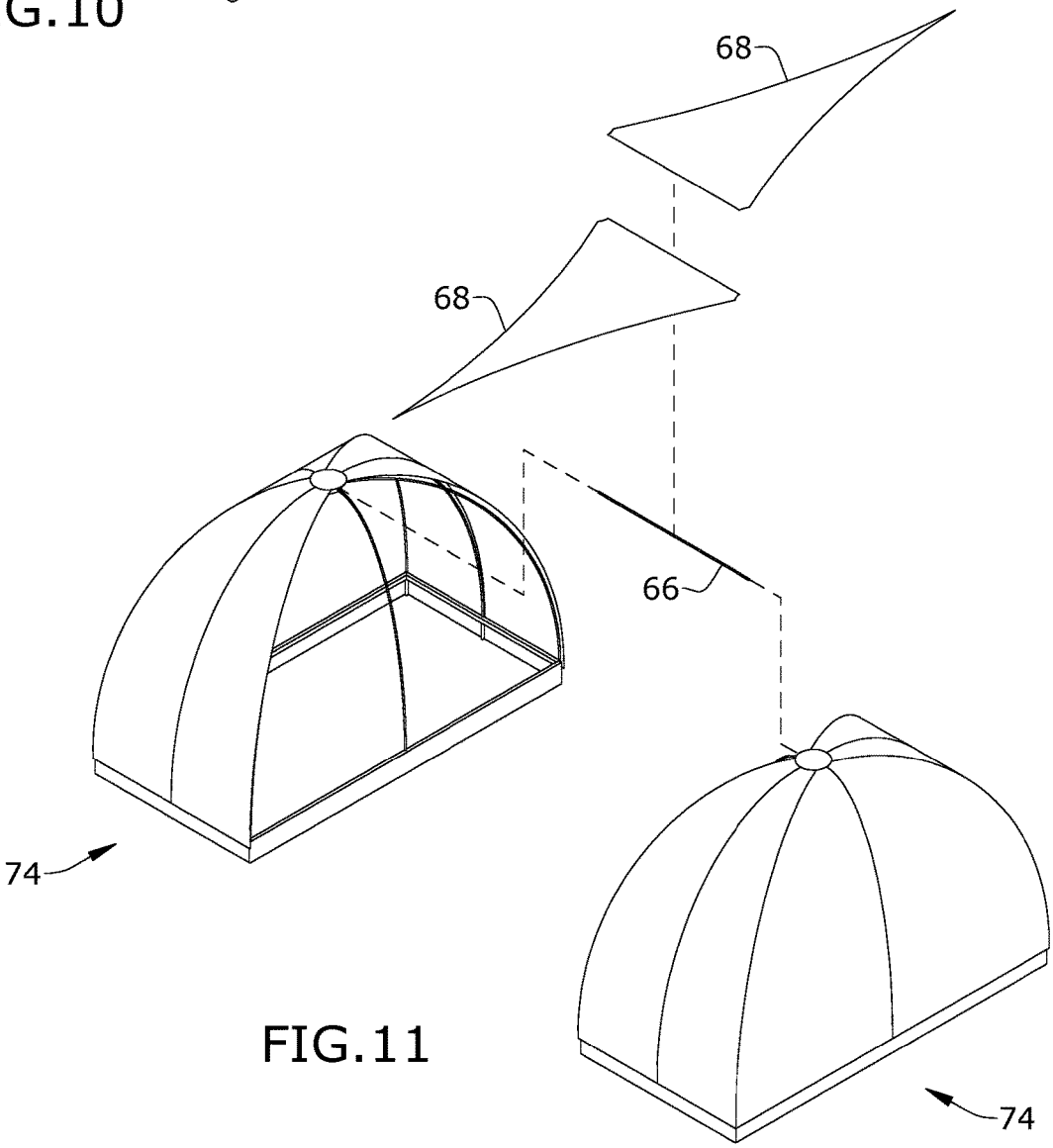
FIG. 11 is an exploded view of the second configuration of FIG. 10.

FIGS. 10-15 are illustrative of exemplary configurations the hub 38 allows for by its unique design. FIGS. 10 and 11 show a configuration of two portable shelters 74 positioned next to one another in a width direction. As shown in the exploded view of FIG. 11, the canopy 36 of each portable shelters 74 may be provided with an open side. A short connecting rod 66 may be used to removably connect with adjacent hubs 38 via respective connecting rod holes 62. To form a larger overall structural unit, one or more canopy wall pieces 68 may be connected with the other canopies 36 using various appropriate means. As those with skill in the art would appreciate, in other embodiments, a larger size, one-piece canopy 36 may be placed over the adjacent portable shelters 74.

Figure 12:
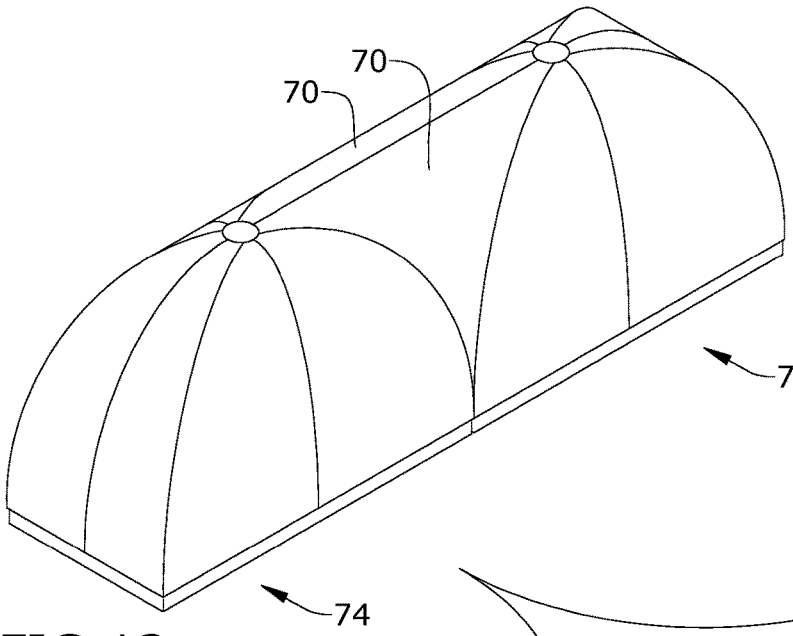
FIG. 12 is a perspective view of the embodiment of the present invention, shown in a third configuration.
Figure 13:
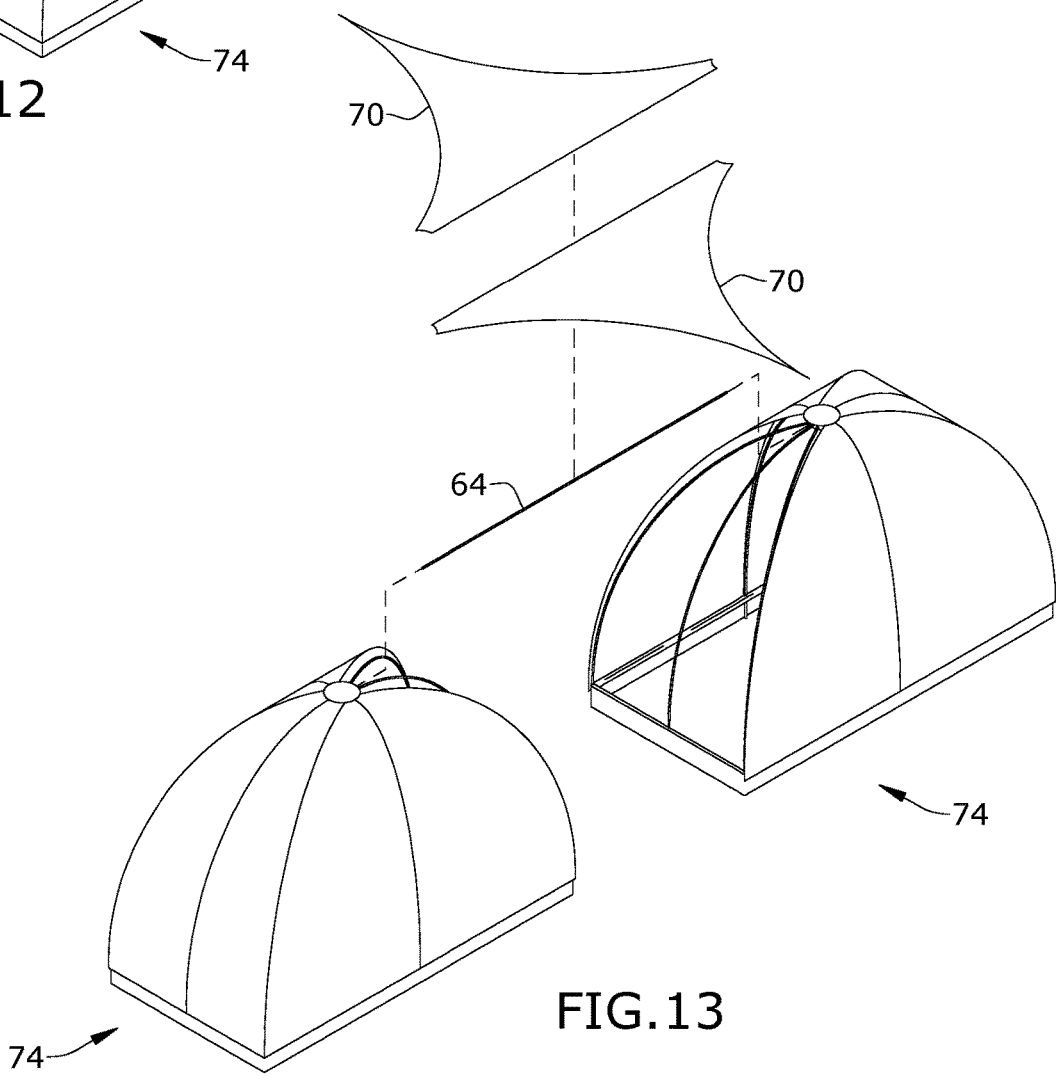
FIG. 13 is an exploded view of the third configuration of FIG. 12.

FIGS. 12-13 illustrate a similar structure to that of FIGS. 10 and 11. In this embodiment, two portable shelters 74 may be positioned up against one another in a length direction. As such, a longer connecting rod 64 may be used to couple to the adjacent hubs 38 (via respective connecting rod holes 62) to form a stable structure. Like the previously described embodiment, one or more canopy wall pieces 70 may be used to fully enclose the larger overall structure created by combining the portable shelters.

Figure 14:
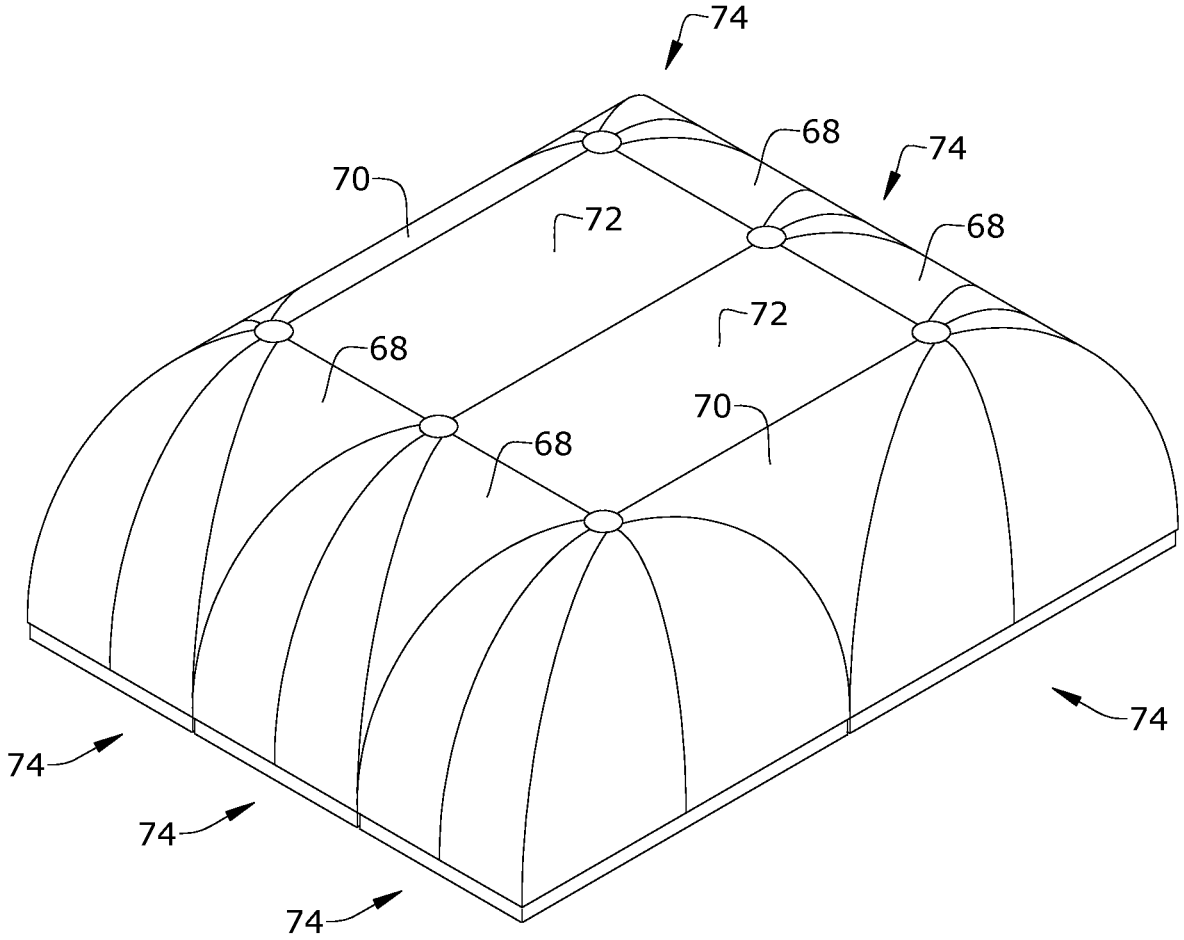
FIG. 14 is a perspective view of the embodiment of the present invention, shown in a fourth configuration.
Figure 15:
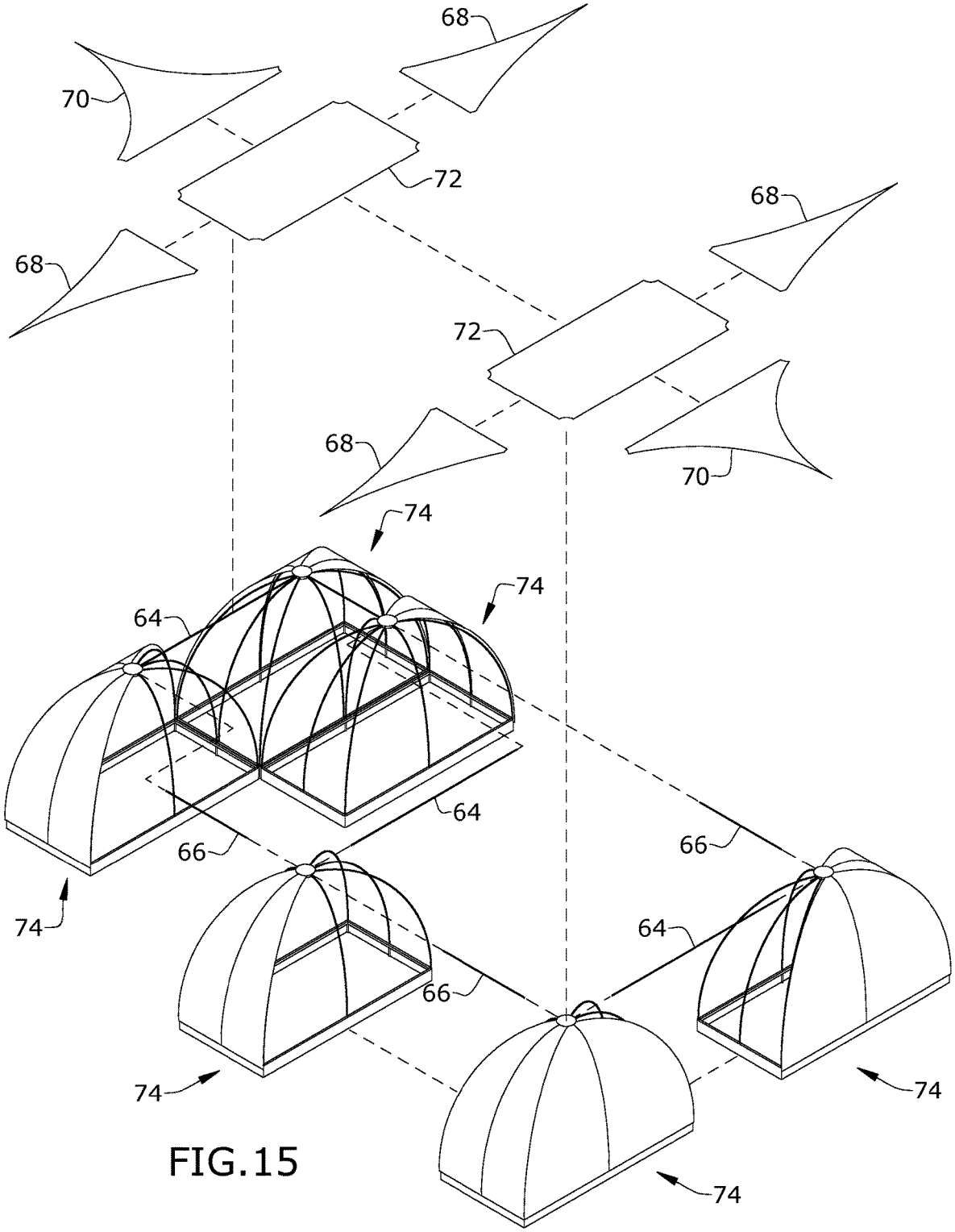
FIG. 15 is an exploded view of the fourth configuration of FIG. 14.

FIGS. 14-15 illustrate a final exemplary configuration to further demonstrate the customizability provided for by the unique hub 38. In this configuration, a set of three portable shelters 74 are stacked next to one another in a width direction. Another set of three portable shelters 74 are situated next to the first set, as shown in FIG. 14. To form the larger overall structure (and to aid in providing stability therefor), adjacent hubs 38 are connected to one another using the aforementioned connecting rods 64, 66 inserted into corresponding connecting rod holes 62 in the hubs 38. Once the poles 40, 42, 44 and the rods 64, 66 have all been assembled with the hubs 38, open portions of the canopy (see FIG. 15 for example) may be may be covered with canopy wall pieces 68, 70 to enclose the structure from the sides (for example, for privacy). In certain embodiments, the top of the structure formed may be left open. In other embodiments, top canopy covers 72 may be coupled to the connecting rods 64, 66 (for example, if the structure is being used as a tent, or to shield from the sun).

As is readily apparent, the hub 38 serves two primary critical purposes: supporting the poles 40, 42, 44 of its respective portable shelter, and allowing for adjacent portable shelters to be connected, while allowing for easy disassembly when the portable shelter(s) are no longer in use. There are a great deal of potential structures that can be formed using the hub 38 of the present invention, which multiply its potential uses and the number of individuals that can be accommodated in various embodiments in accordance with the present invention. Nothing in the prior art comes remotely close to providing all of these advantages in a single, simple product. As such, it will be appreciated that a portable shelter constructed in accordance with the present disclosure may be provided in various configurations. Any variety of suitable materials of construction, configurations, shapes and sizes for the components and methods of connecting the components of the base and/or shelter/canopy portion may be utilized to meet the particular needs and requirements of an end user Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A portable shelter comprising:

a base configured to sit on a surface;

a plurality of support poles, with each support pole comprising a first end that releasably couples to the base and a second end; and a hub defining a plurality of openings along an outer perimeter thereof, with each of the plurality of openings:

being angled downwardly; and slidably receiving a respective second end of a respective support pole of the plurality of support poles, wherein the hub further defines a plurality of holes along the outer perimeter thereof, with the plurality of holes being disposed above the plurality of openings.

2. The portable shelter of claim 1, wherein the hub is substantially cylindrical.

3. The portable shelter of claim 1, wherein the plurality of openings are angled downwardly, relative to a bottom surface of the hub, in the range of approximately four to five degrees.

4. The portable shelter of claim 1, wherein the plurality of openings extend further into the hub than the plurality of holes.

5. The portable shelter of claim 1, wherein each of the plurality of holes are configured to slidably receive a respective connecting rod.

6. The portable shelter of claim 1, further comprising a canopy disposed over and supported by the hub and the plurality of support poles.

7. The portable shelter of claim 1, wherein the base comprises a base bottom and a plurality of base sidewalls that extend upwardly from the base bottom, with the plurality of support poles releasably coupling to the plurality of base sidewalls.

8. A portable shelter system comprising:

a first portable shelter comprising:

a first base configured to sit on a surface;

a first plurality of support poles, with each support pole of the first plurality of support poles comprising a first end that releasably couples to the first base and a second end; and a first hub defining a first plurality of openings along an outer perimeter thereof, with each of the first plurality of openings:

being angled downwardly; and slidably receiving a respective second end of a respective support pole of the first plurality of support poles; and a second portable shelter comprising:

a second base configured to sit on the surface;

a second plurality of support poles, with each support pole of the second plurality of support poles comprising a first end that releasably couples to the second base and a second end; and a second hub defining a second plurality of openings along an outer perimeter thereof, with each of the second plurality of openings:

being angled downwardly; and slidably receiving a respective second end of a respective support pole of the plurality of support poles; and a connecting rod removably coupled to the first hub and the second hub to connect the first portable shelter and the second portable shelter.

9. The portable shelter system of claim 8, wherein the first hub defines a first hole along the outer perimeter thereof and the second hub defines a second hole along the outer perimeter thereof, the connecting rod being removably coupled to the first hub and the second hub within the first hole and the second hole.

* * * * *